US006546611B1

(12) United States Patent
Ryan

(10) Patent No.: US 6,546,611 B1
(45) Date of Patent: Apr. 15, 2003

(54) RAIL CAR ANTI-SPIN DOOR HANDLE AND INSTALLATION METHOD

(75) Inventor: Walter S. Ryan, Mercer, PA (US)

(73) Assignee: Pennsylvania Rail Car Company, Mercer, PA (US)

( * ) Notice: Subject to any disclaimer, the term of this patent is extended or adjusted under 35 U.S.C. 154(b) by 44 days.

(21) Appl. No.: 09/910,408

(22) Filed: Jul. 23, 2001

(51) Int. Cl.[7] ..... G23P 23/00
(52) U.S. Cl. ..... 29/401.1; 49/218; 292/336.3
(58) Field of Search ..... 29/401.1; 49/218, 49/219, 220; 105/310.1, 378, 355; 292/336.3; 220/817, 315, 318

(56) References Cited

U.S. PATENT DOCUMENTS 3,555,731 A * 1/1971 Ross ..... 49/210
3,660,938 A * 5/1972 Ross et al. ..... 49/220
3,786,599 A * 1/1974 Galbarzyk et al. ..... 49/220
3,797,170 A * 3/1974 Lemon ..... 49/220
4,064,810 A * 12/1977 Jenkins et al. ..... 105/378
4,920,894 A * 5/1990 Thoman ..... 105/378

* cited by examiner

*Primary Examiner*—Gregory M. Vidovich
*Assistant Examiner*—Stephen Kenny
(74) *Attorney, Agent, or Firm*—Harpman & Harpman

(57) ABSTRACT

An anti-spin and drift device and installation method for railway plug type car doors that prevents unintentional rapid rotation of the center door operation handle caused by accidental movement of the door. The anti-spin device rapid rotation in both directions and replaces existing pinion gear assemblies and one-directional anti-spin assemblies that interlink the operational handle with the door operating mechanism that activates multiple crank rod assemblies for opening and closing the doors.

11 Claims, 9 Drawing Sheets

RAIL CAR ANTI-SPIN DOOR HANDLE AND INSTALLATION METHOD

BACKGROUND OF THE INVENTION

1. Technical Field

This invention relates to rail car doors that are of the type that are pivoted into and out of closure opening and slide transversely of the rail car wall thereafter.

2. Description of Prior Art

Prior art devices of this type have been directed for use on railway plug doors that use pivotal crank rod assemblies that support the door and crank activation rods that extend to a central door operation handle assembly. Such operational mechanisms have a selector gear with an interconnected activation drive pinion gear. Activation crank rods extend from the selector gear for opening and closing the door. The pinion gear has an operational handle for manual input thereto. Prior art anti-spin drives take the place of a pinion gear and have a ratchet gear engaged by directional pawl. Such devices prevent rapid spinning of the operational handle in one direction if the door is accidentally moved by cargo or loaders. The anti-spin devices of this type can be seen in U.S. Pat. Nos. 3,557,731, 3,660,938 and 4,920,894.

In U.S. Pat. No. 3,555,731 a ratchet lock is disclosed that replaces a standard pinion gear for engagement of a door operational gear. During rotation of the device's drive shaft to open the door from the door opening, the pinion gear will move in a direction to engage and clamp a ratchet wheel between it and a flange fixed to the shaft with an engagement pawl on the ratchet wheel so as to allow the clamped ratchet wheel to rotate in direction with the pinion gear to open the door and prevent rotation of the wheel in opposite direction to close the door.

In U.S. Pat. No. 3,660,938 a brake type drive mechanism is disclosed for plug type rail car doors having a pinion gear on a rotatable input shaft that when the drive mechanism connected to the door crank moves at a rate faster than that of the pinion gear and attached handle the pinion gear will move longitudinally on the drive shaft engaging a ratchet wheel that prevents further movement.

In U.S. Pat. No. 4,920,894 a modular anti-spin unit for railway car doors is disclosed which is secured to the existing handle of the actuation shaft that prevents rapid shaft rotation in one direction by frictional engagement with a ratchet gear.

SUMMARY OF THE INVENTION

The present invention provides for method of retrofitting a railway car door with a dual action multi-directional safety mechanism by replacing a standard pinion gear or one-way anti-spin mechanism. The safety mechanism includes a pair of rotatable pinion gears that have extended engagement travel restriction lugs extending therefrom. The pinion gears are threadably positioned on a handle drive shaft with a ratchet gear assembly being rotatably positioned over the respective lugs between frictional rings and held in place by respective apertured pressure plates. Upon unintentional rapid rotation of the drive handle shaft, the friction ring wedgeably engages the ratchet gear stopping directional rotation of the pinion gear interconnected therewith.

A method for replacing an existing rail car door handle activation assembly including multiple steps of removing and modifying existing components and adding selected fittings required to adapt the dual action anti-spin, anti-drift safety mechanism to an existing rail car door assemblies.

DESCRIPTION OF THE PREFERRED EMBODIMENT

Figure 1:
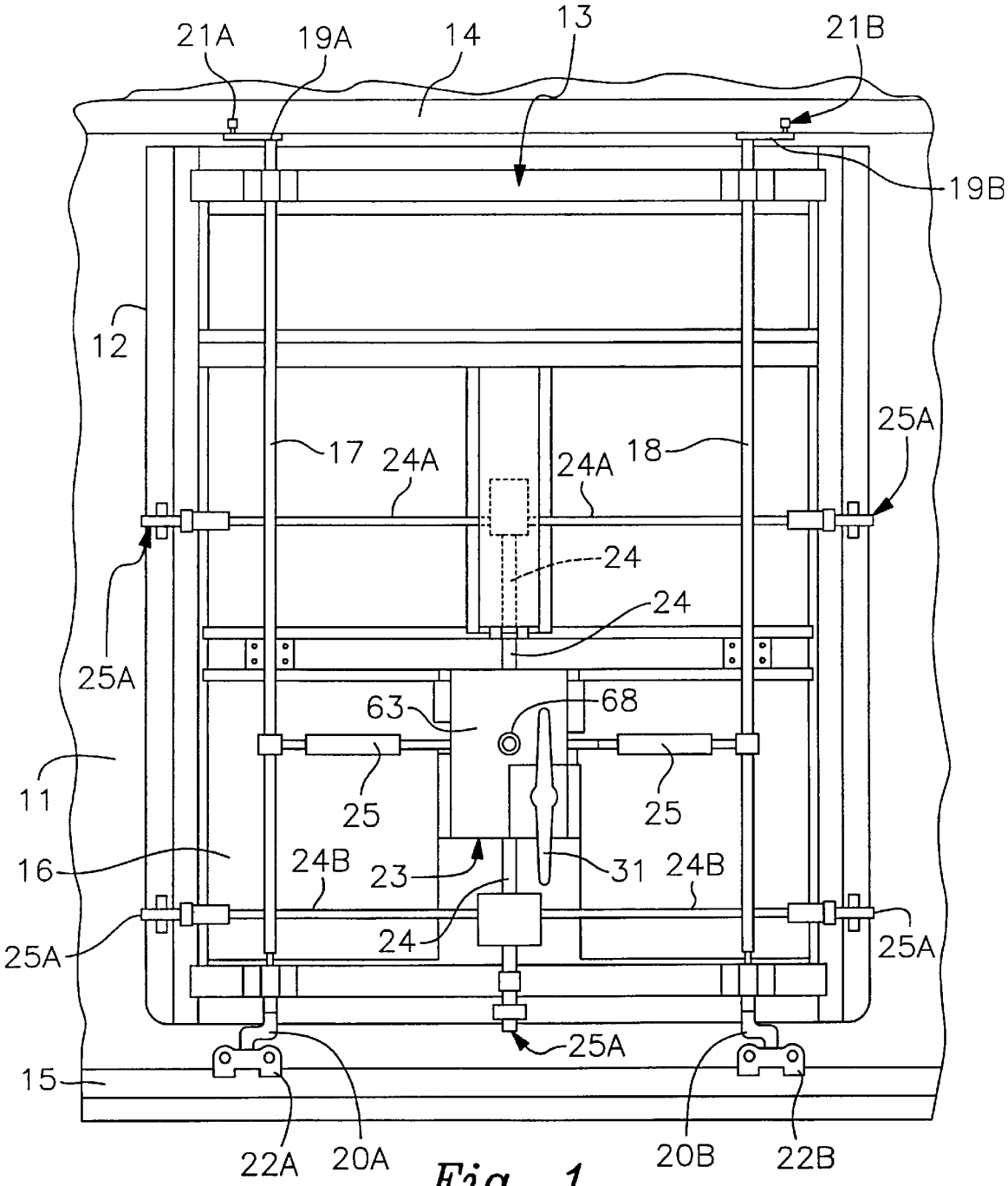
FIG. 1 is a side elevational view of a railroad car plug type door.
Figure 2:
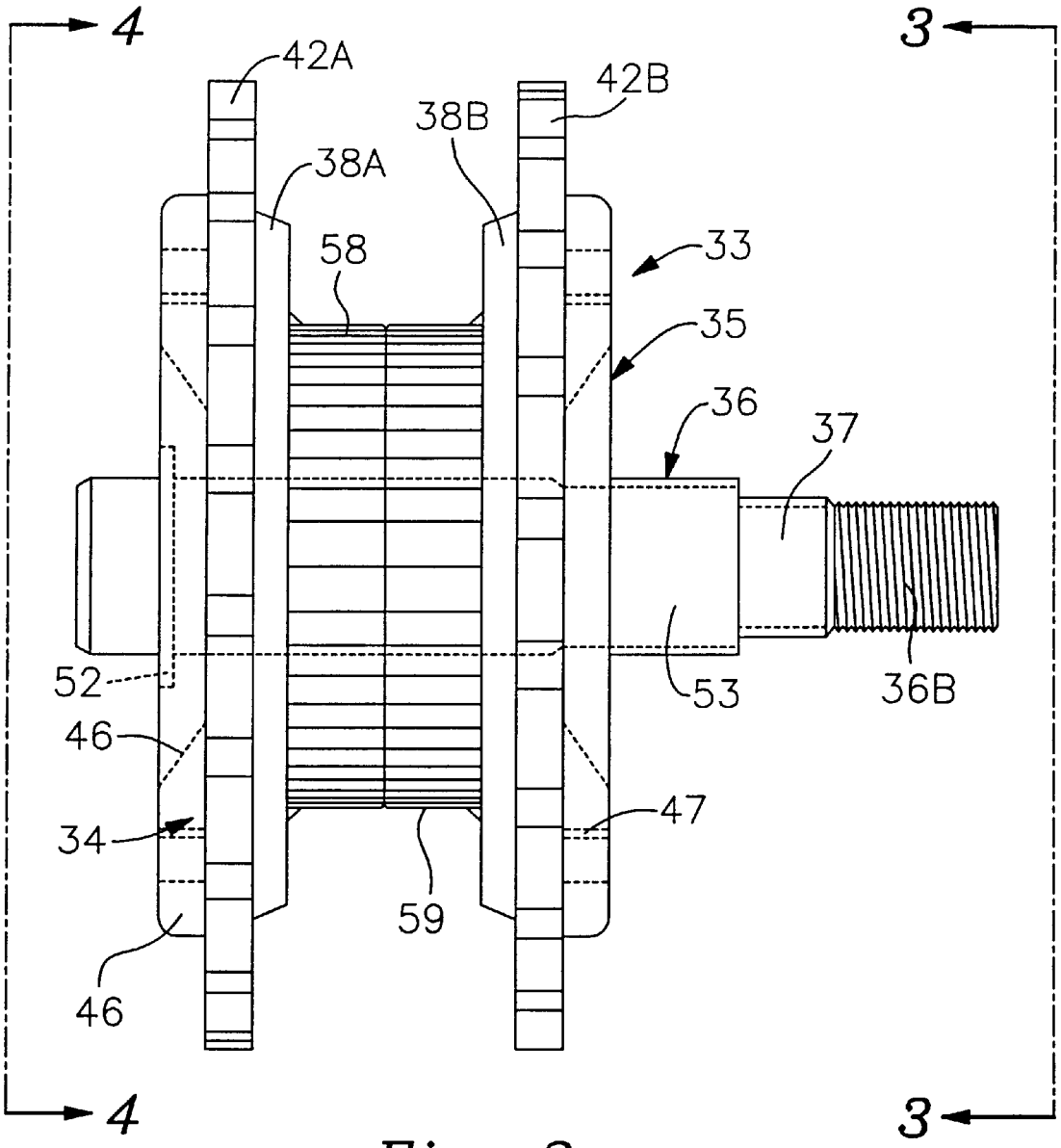
FIG. 2 is a side elevational view of a dual action anti-spin drift mechanism in assembled form.

Referring now to FIG. 1 of the drawings, a railroad car 10 can be seen having a sidewall 11 with a car door opening 12 therein. A plug door assembly 13 is positioned for sealing relation with the opening 12. Door support rails 14 and 15 are positioned above and below the opening 12 for engagement with the door assembly 13. A plug door 16 is supported by a pair of crank rod assemblies 17 and 18 and are secured to the door 16. The upper and lower ends of the crank rods each have lateral extending arm cranks 19A and 19B, 20A and 20B which are pivotally engaged by respective roller and wheel assemblies 21A and 21B, 22A and 22B in the respective rails 14 and 15 as will be well understood by those skilled in the art.

A door operating assembly 23 is secured to the door 16 having pairs of actuation rods 24 and 25. The rods 24 extend to a plurality of lock bolt members 25A positioned around the perimeter edge of the door 16. The corresponding rods 25 are interengaged to the crank rods 17 and 18 for rotational movement thereof for the opening and closing the door as will be described in greater detail hereinafter.

Figure 9:
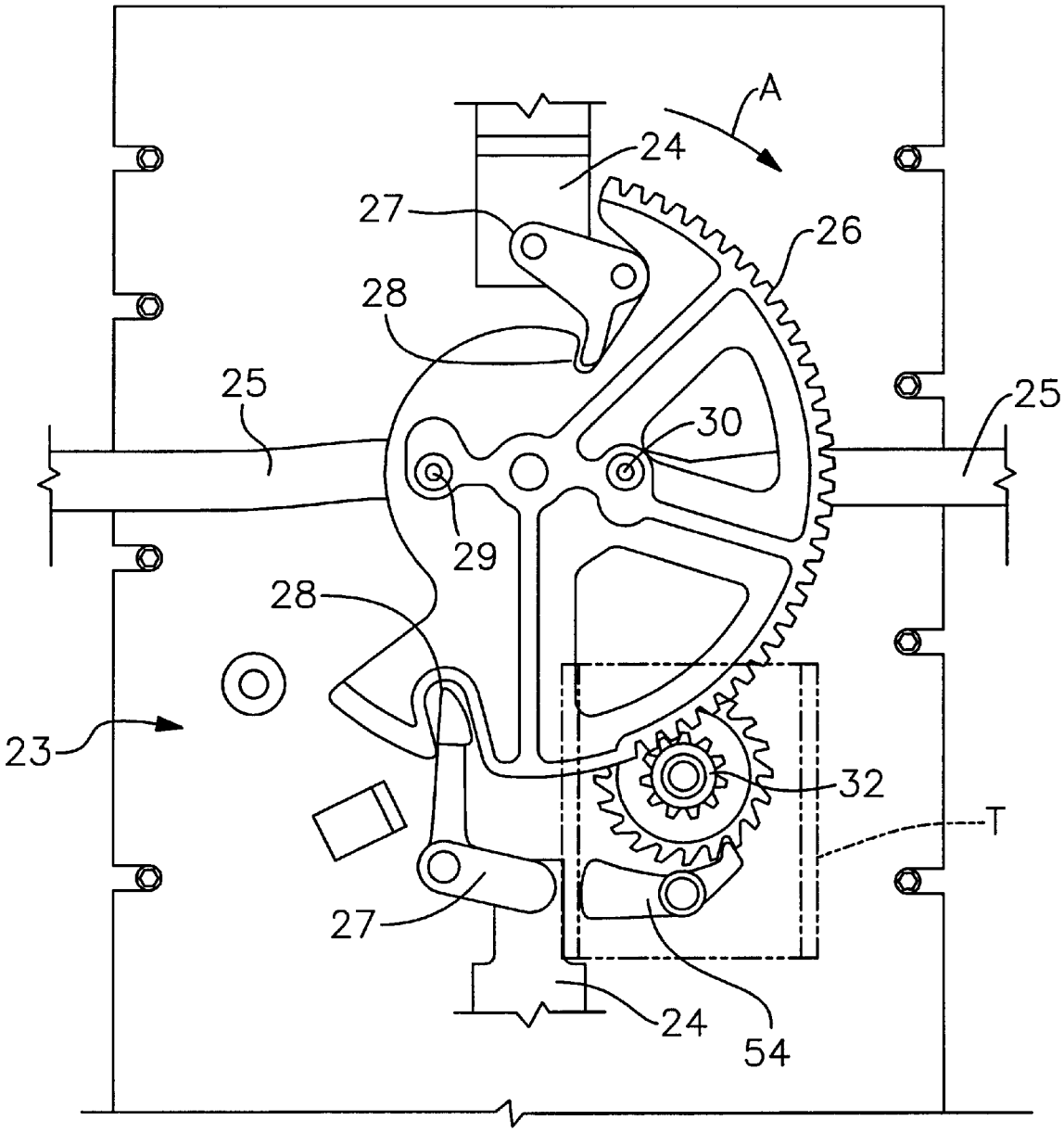
FIG. 9 is an enlarged front elevational view of the door operating mechanism.

The actuation rod pairs 24 and 25 are in communication with a selector gear 26, best seen in FIG. 9 of the drawings. The vertical oriented activation rods 24 are pivotally connected to respective arm cranks 27 which are received within recesses 28 formed in the selector gear 26. Correspondingly, the horizontally oriented activation rods 25 are pivotally secured to the selector gear 26 by respective pivot points 29 and 30.

It will be apparent that upon clockwise rotation of the selector gear 26 as indicated by the rotational arrow A, it will accordingly retract the activation rods 24A and 24B and the activation rods 25 releasing the lock bolt mechanisms 25A and rotating the crank rods 17 and 18 on their longitudinal axis respectively, unsealing the door 16 and pivoting it outwardly from the opening 12.

The selector gear 26 is driven by the rotation of a door handle 31 and attached pinion gear 32 illustrated in FIG. 9 of the drawings. A safety anti-spin device 33 illustrated in FIG. 3 of the drawings replaces the existing pinion gear 32 providing dual action anti-spin and drift features to the operation assembly as indicated by the selection gear 26.

Referring now to FIGS. 2–8 of the drawings, the safety anti-spin device 33 can be seen having a pair of pinion gear assemblies 34 and 35 threadably positioned on a drive shaft 36 at 36A. The handle 31 is registerable on a squared engagement portion 37 of the shaft 36 and retained by a nut 67 shown in broken lines threadably positioned on one end of the drive shaft 36 at 36B.

Figure 5:
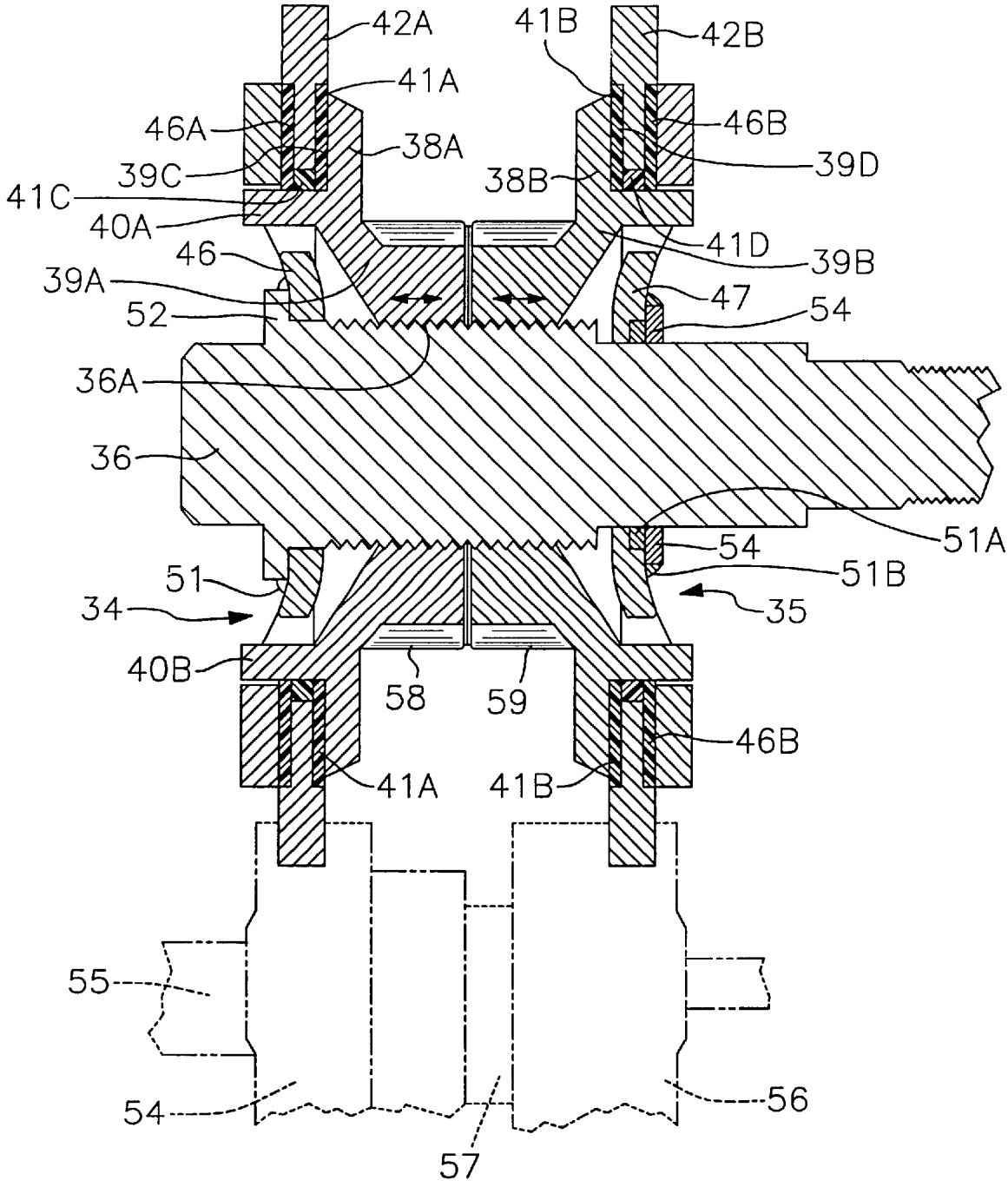
FIG. 5 is a cross-sectional view of the dual action anti-spin and drift mechanism.
Figure 6:
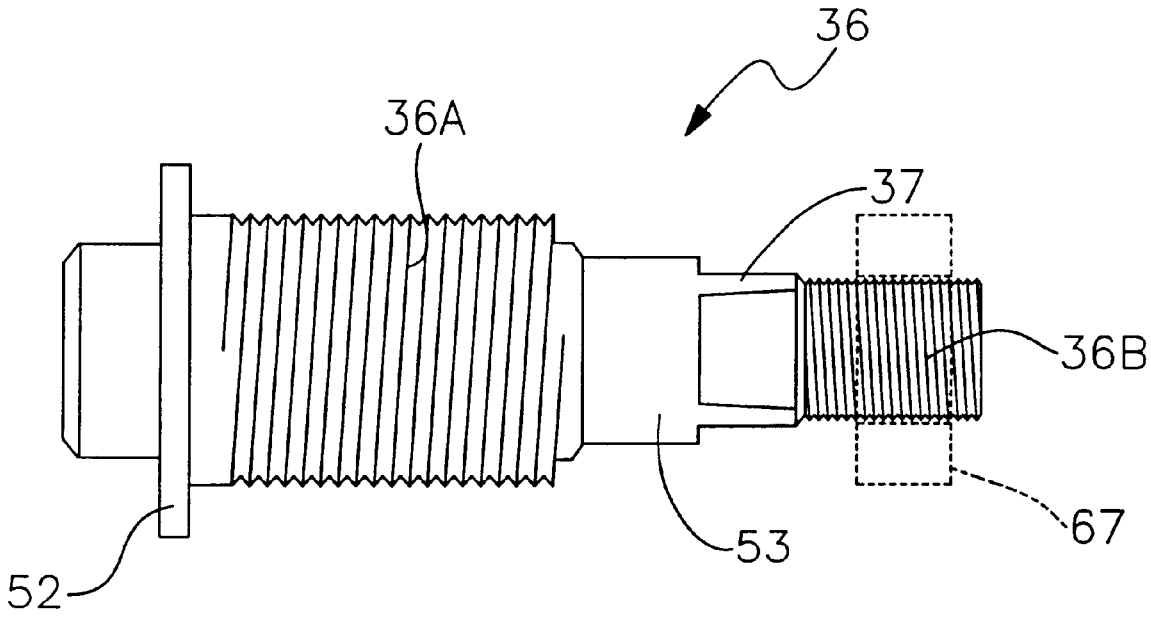
FIG. 6 is an enlarged side elevational view of the handle drive and assembly shaft of the invention.
Figure 7:
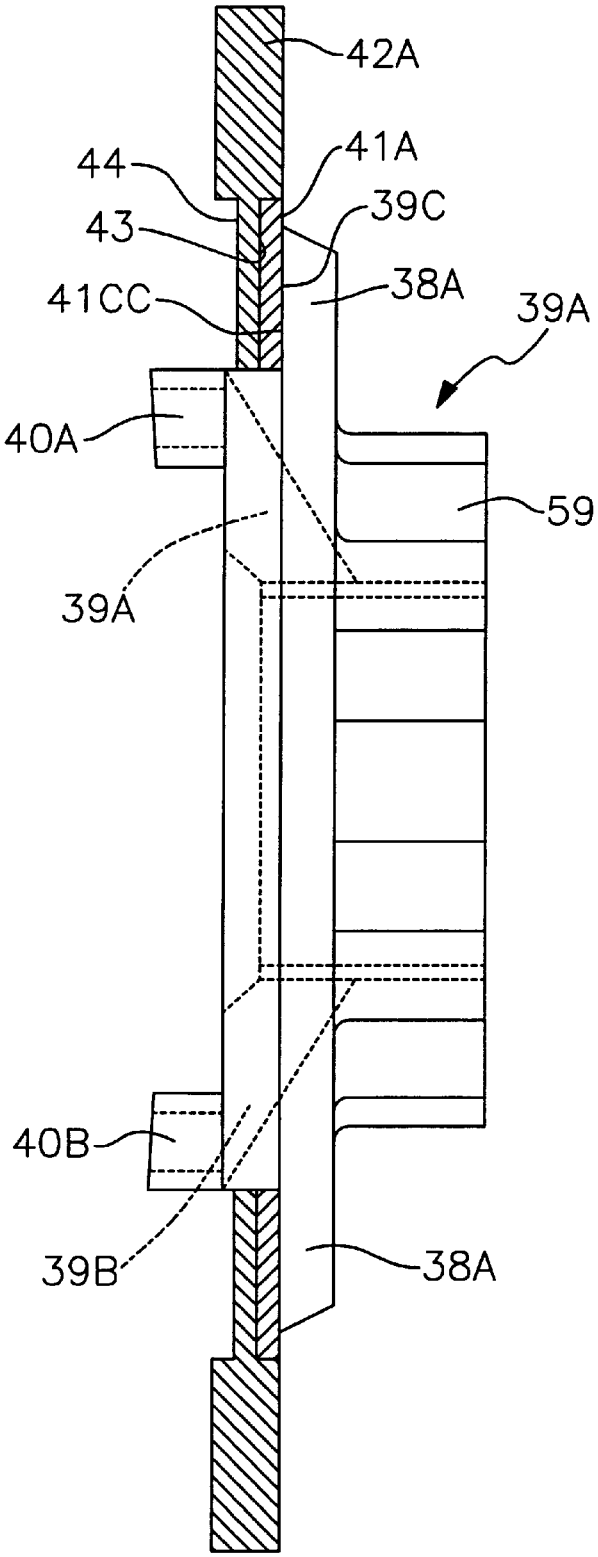
FIG. 7 is an enlarged side elevational view of a pinion gear.
Figure 8:
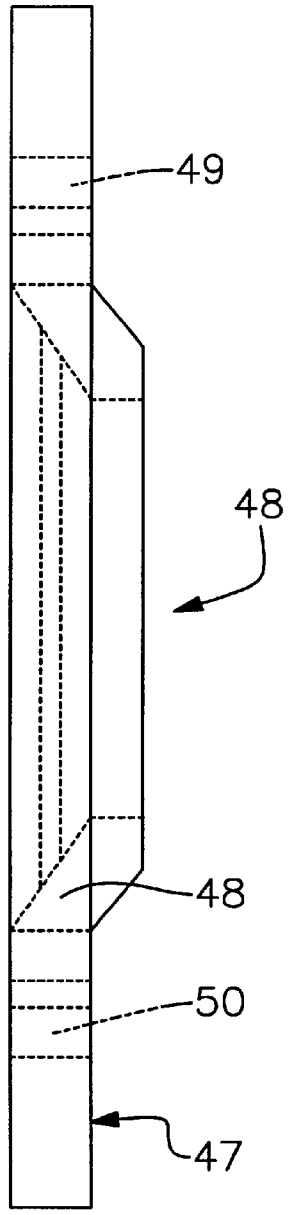
FIG. 8 is an enlarged side elevational view of a retaining pressure plate as seen in FIG. 3.

Referring now to FIGS. 5 and 7 of the drawings, it will be seen that the pinion gear assemblies 34 and 35 each respectively have an annular flange 38A and 38B defining an annular tapered portion fittings 39A and 39B extending therefrom. A pair of oppositely disposed arcuate lugs 40A and 40B extend from the respective tapered portions 39A and 39B. The respective flanges 38A and 38B have smooth engagement surfaces 39C and 39D that receive first respective first frictional washers 41A and 41B as best seen in FIG. 5 of the drawings. The second frictional washers 41C and 41D are positioned over the lugs 40A and 40B abutting the first washer 41A and 41B. Respective ratchet wheels 42A and 42B having oppositely disposed recessed portions 43 and 44 about a central opening therein are rotatably positioned over the respective second friction washers 41C and 41D bearing thereon. The respective ratchet wheels 42A and 42B are positioned to be directionally reversed to one another as will be discussed in greater detail hereinafter. A third frictional washer pair 46A and 46B identical to the first frictional washer pair is engaged within the respective oppositely disposed recess portion 44.

A pair of pressure engagement plates 46 and 47, best seen in FIGS. 3, 4, 5 and 8 of the drawings have vertically offset apertured center portions 48 and a pair of oppositely disposed arcuate slots 49 and 50 therein. The plate 46 is retained in position on the drive shaft 36 by welding at 51 to a retaining flange 52 on the drive shaft 36 with the lugs 40A and 40B extending through respective openings at 49 and 50 therein. It will be evident from the above description when viewing FIG. 5 of the drawings, that the remaining pinion gear assembly is identical with the exception of the pressure plate 47 that has a central opening of a reduced dimension to registerably engage the area of reduced drive shaft dimension at 53 and is welded to the drive shaft 36 at 51A. A flat retaining washer 54 is positioned on the drive shaft 36 portion 53 and is secured to the pressure plate 47 by welding at 51B.

Figure 3:
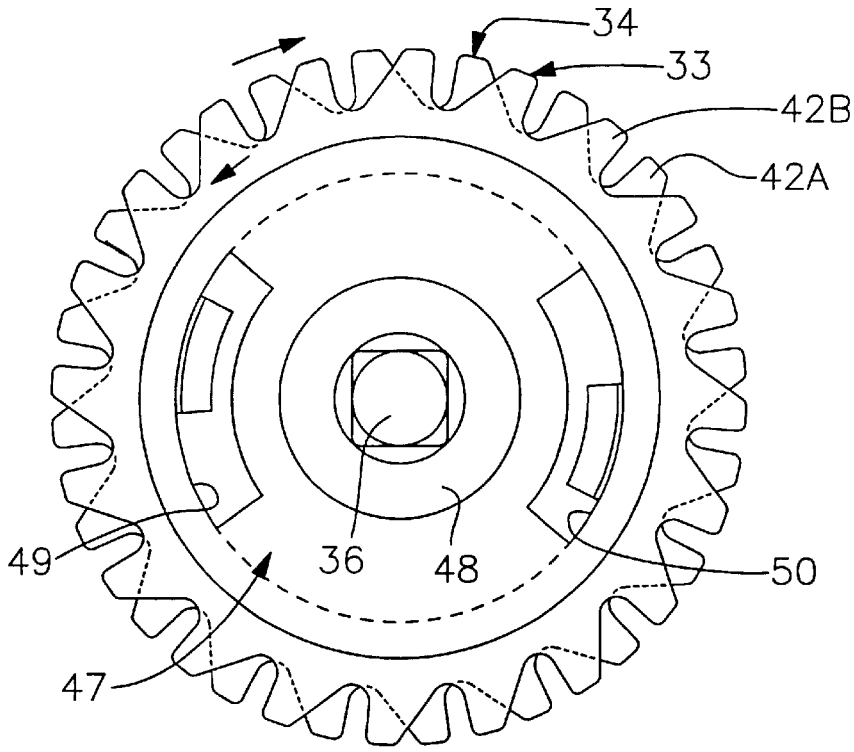
FIG. 3 is an end view on lines 3—3 of FIG. 2 illustrating ratchet gear teeth direction.
Figure 4:
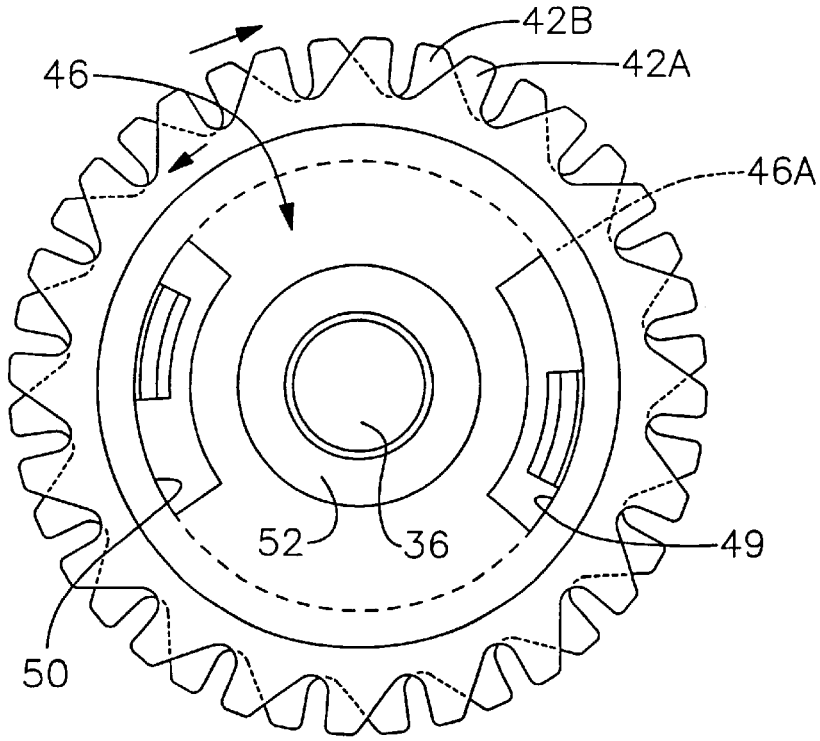
FIG. 4 is an end view on line 4—4 of FIG. 2.
Figure 11:
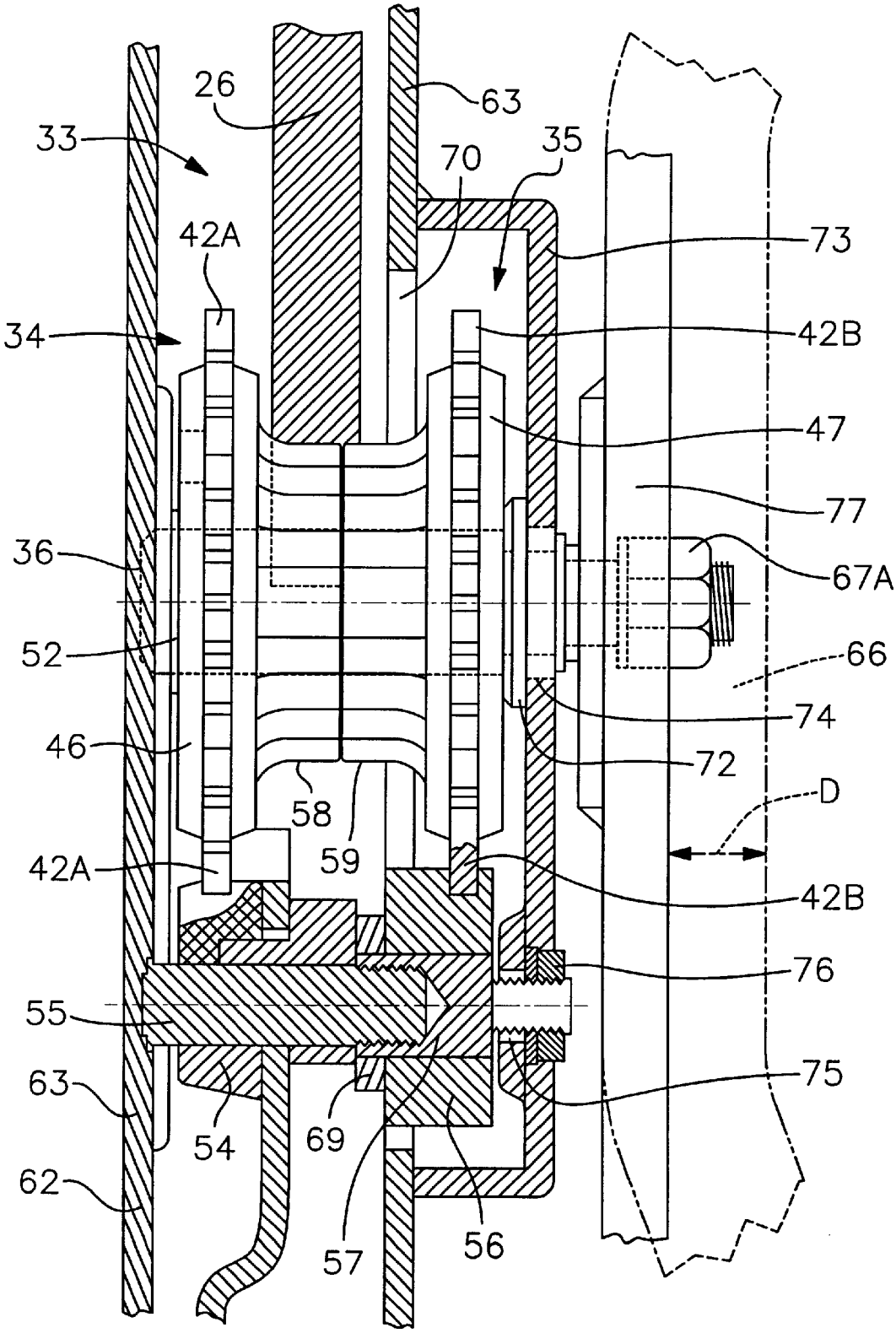
FIG. 11 is a partial cross-sectional view of a railway car door retrofitted with a dual action anti-spin and drift device.

Referring now to FIGS. 5 and 11 of the drawings, a ratchet engagement pawl assembly 53 can be seen having a first ratchet pawl 54 on a support shaft 55 arranged for directional engagement with the ratchet wheel 42A providing counter clockwise rotation as viewed from FIG. 3 of the drawings. A second ratchet pawl 56 is positioned on an extension shaft element 57 of the invention as will be discussed in greater detail hereinafter and is engaged on the ratchet wheel 42B which will prevent rotation in a clockwise direction.

In operation, as the rail car door 16 is opened the handle 31 is rotated in a counter clockwise direction. The drive shaft 36 is in turn rotated causing the pinion gear assembly 33 to move marginally engaging the assembly's first friction washer 41B on the ratchet wheel 42B and correspondingly to engage the pressure plate 47 via the second frictional washer 41D. The ratchet pawl 56 prevents clockwise rotation of the ratchet wheel 42B when engaged as noted. The lugs 40A and 40B limit travel of a pinion gear portion 58 by their respective engagement within the travel slots 49 and 50 of the pressure plate 46 as hereinbefore described.

It will be evident that as the counter clockwise rotation continues, the pinion gear portion 58 will drive the selection gear 26 clockwise as seen in FIG. 9 releasing the door locks 25A and rotating the crank shaft rods 17 and 18 moving the door 16 outwardly from the door opening 12. Should the door be forced outwardly by the contents of the rail car or sudden unintentional rotation of the selection gear 26 occur, the gear will in turn rotate the inner connected pinion gear portion 58 and correspondingly handle 31 over spinning causing injury to the operator (not shown). Rotation of the pinion gear portion 58 in a counter clockwise direction at a rate greater than the rate at which it is being rotated by the handle 31. This will cause the pinion gear portion 58 to rotate marginally on the drive shaft 36 to engage the ratchet wheel 42A thus preventing further rotation of the handle 31 by the action of the pawl 54. Once the force on the door is released, the handle 31 can again be rotated in a counter clockwise direction to continue opening the door 16.

Once the door 16 is fully opened and closing of the door 16 is desired then clockwise rotation of the handle 31 will cause the pinion gear assembly 35 to move on the drive shaft 36 and engage the friction washer 41B of the ratchet wheel 42B locking same to the pinion gear portion 59 and rotate therewith. The pawl 56 prevents counter clockwise rotation in the same sequence of events as described above with the pinion gear assembly 34.

It is important to note that by the use of independent pinion gear portions 58 and 59 with both inner engaging the selection gear 26, that the incremental gear play therebetween allows for lock release of the non-engaged pinion gear assembly to its respective ratchet wheel under reverse rotation sequence in regards to one another. This is a critical improvement over monolithic pinion gear assemblies of prior art in which unlocking of the opposite friction engagement assembly is difficult.

Correspondingly, if the door 16 is forced closed by an outside force, the selection gear 26 will rotate the pinion gear portion 59 at a speed greater than normal closing rotation and correspondingly cause the pinion gear assembly 35 to rotate marginally on the drive shaft 36 engaging the ratchet wheel 42B preventing further rotation as hereinbefore described by the engagement action of the pawl 56.

Figure 10:
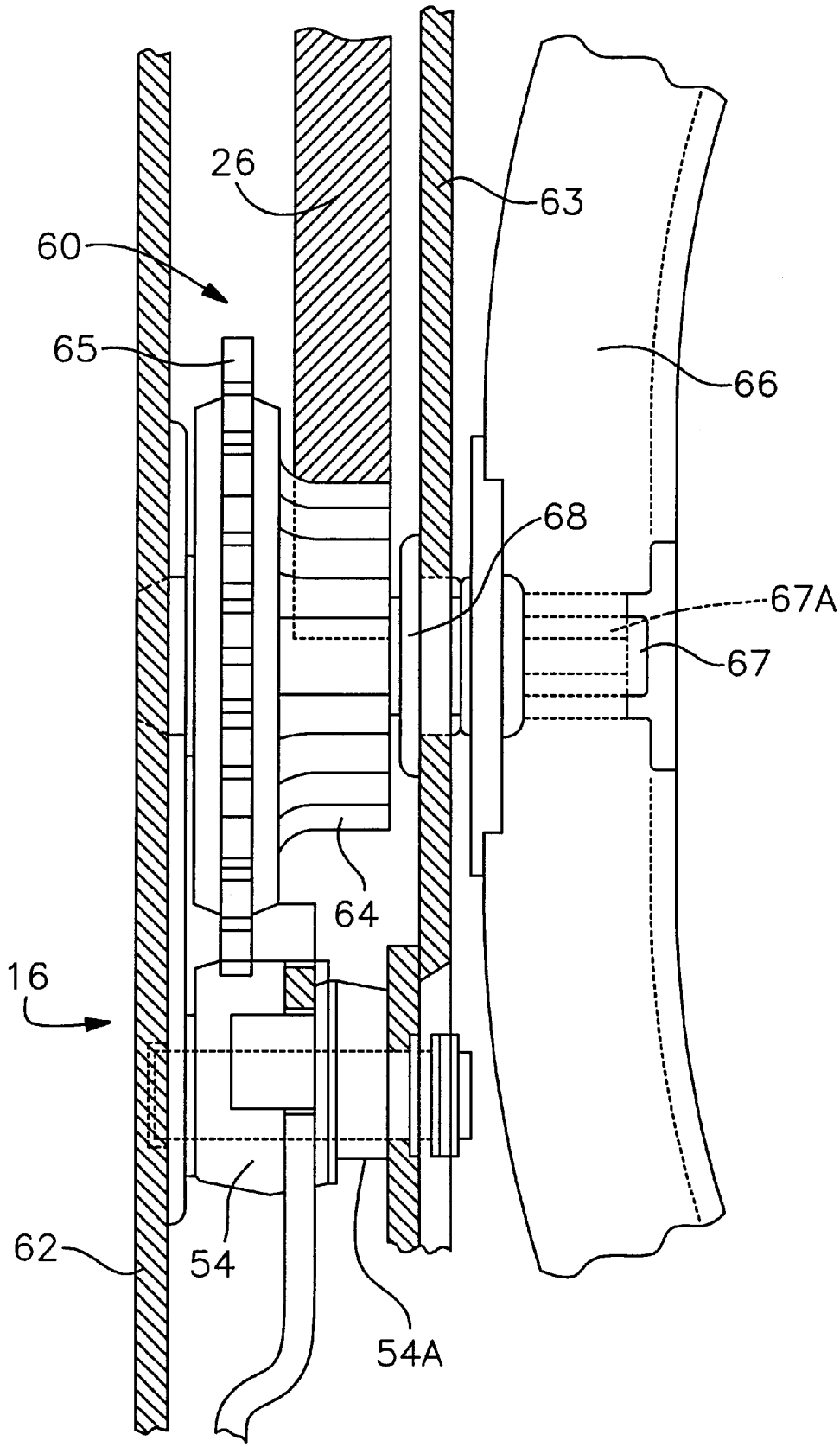
FIG. 10 is a partial sectional view of a portion of the rail door with a one-way ratchet lock installed therein.

Referring now to FIGS. 10 and 11 of the drawings, a method of replacing an existing one-directional anti-spin anti-drift device 60 can be seen and described hereinafter. The rail door 16 has a rear support wall 62 and spaced front cover plate 63. The existing one-directional anti-spin device 60 is positioned within having the selection gear 26 engaged on a pinion gear 64. Existing pawl assembly 54A with pawl 54 directionally engages a ratchet fitting 65. An activation handle 66 is secured to a drive shaft 67 by a retainer nut 67A as best seen in FIG. 10 of the drawings.

Referring now to FIG. 11 of the drawings, the dual action anti-spin, anti-drift device 33 of the invention is inserted in the following sequential steps.

The original door handle 66 is removed via a retainer nut 67A. The front cover plate 63 (also illustrated in FIG. 1 for reference) is removed along with a snap ring 68.

Removal and discarding the original anti-sp in, anti-drift device 60.

Remove and save the original ratchet pawl 54 and discard associated spacer 54A.

Install the ratchet anti-spin anti-drift assembly 33 of the invention by pulling the selection gear 26 forward to provide clearance and then backwards for engagement with the multiple pinion gear portions 58 and 59 of the anti-spin assembly 33 as it is positioned in the door 16 as seen in FIG. 11 of the drawings.

Re-install the original ratchet pawl 54.

Apply a pawl washer 69 on top of the ratchet pawl 54 then threadably secure the ratchet pawl stud extension 57 and confirm ratchet pawl 54 and washer 69 are free turning thereon.

Position a second ratchet pawl 56 on the stud extension 57.

Modify the original cover plate 63 by cutting a clearance opening at 70 using a guide template (not shown) but position illustrated by broken lines T in FIG. 9 of the drawing.

Re-install modified cover plate 63A, positioning and installing a stainless steel bushing 72 on the drive shaft 36.

Positioning a secondary cover plate 73 having a handle aperture at 74 and mounting aperture at 75 over the axis opening at 70.

Registering respective drive shaft 36 and pawl extension 57. Temporarily securing same with lock nut 76.

Ideally, the door handle 66 is repositioned on the drive shaft 36 and secured by the original lock nut 67A. In most applications, however, due to the overall rail car width restriction, a new door handle 77 illustrated in FIG. 11 of the drawings in solid lines must be used which has a less longitudinal offset as indicated by comparison with original handle 66 shown in broken lines with a dimensional difference indication therebetween at D.

Once the proper door operation has been confirmed, the cover plate 73 is tack welded into place, as illustrated.

As set forth in the method steps above, the dual action anti-spin anti-drift device 33 of the invention will prevent unintentional rapid handle rotation in either direction by braking engagement with the respective pinion gear fittings 34 and 35 and respective interconnected pawls 54 and 56 of rotational limitation on the engagement for respective ratchet wheels 42A and 42B.

Accordingly, directional non-restrictive rotation of the ratchet wheels 42A and 42B is possible by reverse ratchet direction orientation with respect to teeth orientation thereon and pinion gear independent assemblies directed therebetween.

It will therefore be apparent to those skilled in the art that various changes and modifications may be made therein without departing from the spirit of the invention. Therefore I claim:

What is claimed is:

1. A dual action anti-spin replacement method and apparatus for rail car plug doors comprises, a. removing a center door operating handle of a door opening and closing operating assembly b. removing an operational assembly cover plate secured to said rail car door c. remove and discard a pinion gear and drive shaft assembly that interengages a selector gear of the door operating assembly d. removing and retaining a first ratchet wheel engagement pawl pivotally secured on a pawl support shaft e. positioning a dual action anti-spin apparatus within said rail car door for engagement with said selector gear of the door operating assembly f. re-positioning said first ratchet wheel engagement pawl on the pawl support shaft for directional registration with a first ratchet wheel of said dual action anti-spin device g. rotatably position a second ratchet engagement pawl on said pawl shaft extension for directional restrictive registration with a second ratchet wheel of said dual action anti-spin assembly h. positioning a modified operational assembly cover plate on said rail car door i. secure an apertured dual action anti-spin cover plate onto said modified operation assembly cover plate in respective apertured registration with a activation drive shaft of said dual action anti-spin assembly and said pawl support shaft extension j. securing a center door operational handle onto said drive activation shaft and threadably position a lock nut onto the pawl support shaft extension.

2. The dual action anti-spin replacement method set forth in claim 1 wherein said pawl shaft extension is threadably secured to said pawl support shaft portion.

3. The dual action anti-spin replacement method set forth in claim 1 wherein said a pawl washer is positioned on said pawl support shaft.

4. The dual action anti-spin replacement method set forth in claim 1 wherein said modified operational assembly cover plate is modified by cutting an access opening therein that corresponds to a pre-determined dimension.

5. The dual action anti-spin replacement method set forth in claim 1 wherein said drive activation shaft has a bushing positioned thereon.

6. The replacement method set forth in claim 1 wherein said first and second ratchet wheels have oppositely disposed annular recessed areas about a central opening therein.

7. The respective method set forth in claim 1 wherein said wheeled gear of the door operating assembly inter-engages door activation bars interconnected to door crank rods for opening and closing said rail car door.

8. The method of retrofitting the anti-spin apparatus set forth in claim 1 wherein said dual action anti-spin apparatus comprises, a pair of pinion gear assemblies threadably positioned on said drive activation shaft for independent movement thereon tapered locking assemblies on said respective pinion gear assembly for inhibiting torque transfer from the selection gear of said door operation assembly to said drive activation shaft in both a door opening and door closing direction, the locking assemblies respectively comprising, the first and second ratchet wheels in reverse orientation to one another for opposite directional restrictive engagement with said respective ratchet pawls friction fittings selectively registerable between said ratchet wheels, pinion gear friction engagement portions and a retaining engagement plate secured to said activation drive shaft in spaced relation to said pinion gear portion, a non-metallic bearing ring on said pinion gear friction engagement portion registerable with said ratchet wheel auto directive locking release means for releasing said respective engagement friction fittings on selective directional load input.

9. The replacement method set forth in claim 8 wherein said auto directive locking release means comprises independent pinion gear rotation on said drive activation shaft under door load on said wheeled gear of the door operating assembly.

10. The replacement method set forth in claims 7 and 8 wherein said friction fittings comprises, non-metallic washers registerable within said respective annular recesses in said respective ratchet wheels and a pinion gear tapered portion.

11. The replacement method set forth in claim 8 wherein said respective pinion gear portions for selective engagement with said friction fitting comprises an annular flange defining a friction engagement surface in oppositely disposed relation to said ratchet wheeled recesses.

* * * * *